US007429205B1

(12) United States Patent
Huang

(10) Patent No.: US 7,429,205 B1
(45) Date of Patent: Sep. 30, 2008

(54) BRA CUP SUPPORT STRUCTURE

(76) Inventor: Huei-Rong Huang, No. 29, Lane 187, Cyong Lin S. Road, SinJhuang City, Taipei County (TW)

( * ) Notice: Subject to any disclaimer, the term of this patent is extended or adjusted under 35 U.S.C. 154(b) by 0 days.

(21) Appl. No.: 11/764,358

(22) Filed: Jun. 18, 2007

(51) Int. Cl.
*A41C 3/10* (2006.01)
*A41C 3/12* (2006.01)

(52) U.S. Cl. ..... 450/39; 450/57; 450/41; 2/267

(58) Field of Classification Search ..... 450/41–52, 450/39, 92, 93, 54–58
See application file for complete search history.

(56) References Cited

U.S. PATENT DOCUMENTS 2,595,088 A * 4/1952 Licht ..... 450/52
3,101,717 A * 8/1963 Korman ..... 450/39
3,266,495 A * 8/1966 Sachs ..... 450/55
5,472,366 A * 12/1995 Moore ..... 450/41
6,106,363 A 8/2000 Werner
6,837,771 B2 * 1/2005 Falla ..... 450/39
7,179,150 B2 * 2/2007 Luk et al. ..... 450/39

* cited by examiner

*Primary Examiner*—Gloria Hale
(74) *Attorney, Agent, or Firm*—Rabin & Berdo, P.C.

(57) ABSTRACT

A bra cup support structure for supporting and uplifting users' breast with comfort. The bra cup support structure comprises an exterior layer, a holder, and an interior layer, wherein the exterior and interior layers are made of fabric and foam. The holder is made of a polymeric material, metal slice or flat metal wire, and firmly sandwiched between the exterior layer and interior layer, and a length of the holder is shorter than a length of both layers. Consequently, the bra cup support structure has, as a cross-sectional shape taken perpendicular to its lengthwise direction, an inverted-L shape with an upper portion and a lower portion, the lower portion extending downward from an edge of the upper portion. The holder is disposed within the lower portion.

3 Claims, 5 Drawing Sheets

BRA CUP SUPPORT STRUCTURE

FIELD OF THE INVENTION

The invention is related to a breast support apparatus, and more particularly, to a bra cup support structure.

BACKGROUND OF THE INVENTION

Underwires are usually utilized to provide supporting and shaping functions for the cup of bra, and conventionally inserted into fabric sleeves disposed at the lower periphery of the bra cups to support users' breasts. Traditionally, the underwires are made of some rigid materials and make users uncomfortable.

U.S. Pat. No. 5,472,366 published on Dec. 5, 1995, titled "Flexible Bra Cup Support" disclosed the flexible support element takes the form of an arcuate length of polymeric or similar materials having a circular cross-sectional shape to fit within the undercup sleeves. Besides, U.S. Pat. No. 6,106,363 published on Aug. 22, 2000, titled "Brassiere with Helical Underwire" described the flexible bra-cup support for brassieres are formed by a length of generally helical coil spring.

Conventional underwires made of rigid materials exhibit substantial deficiencies. For example, the underwires often make users discomfort and poke through the undercup fabric sleeves. In the present invention, non-rigid materials are adopted to form an improved bra cup support structure. Consequently, the bra cup support structure remains the support function like the conventional underwire and further overcomes the above disadvantages.

SUMMARY OF THE INVENTION

The main object of the present invention is to provide an improved bra cup support structure comprising an exterior layer, a holder, and an interior layer, wherein the exterior layer is composed of an outer fabric layer and outer foam layer, and the interior layer is composed of an inner fabric layer and inner foam layer. Besides, the outer fabric layer and outer foam layer are laminated adhesively with glue, and the inner fabric layer and inner foam layer are laminated adhesively with glue, too. The interior layer is disposed adjacent to the exterior layer. In addition, the holder is made of a polymeric material, metal slice or flat metal wire, and firmly sandwiched between the exterior layer and interior layer, and a length of the holder is shorter than a length of both layers. The bra cup support structure has, as a cross-sectional shape taken perpendicular to a lengthwise direction of the bra cup support structure, an inverted L-shape with an upper portion that is for contacting and supporting a breast of a user, and a lower portion disposable under the breast, and for contacting a torso of the user. The holder is thereby disposed within the lower portion to enhance strength of support function of bra cup support structure. The lower portion extends downward from an edge of the upper portion. Accordingly, the bra cup support structure is provided a user with comfortable feel and support function Furthermore, a length of the holder is shorter than a length of the exterior layer and interior layer. Additionally, the holder is disposed within the lower portion of the bra cup support structure, wherein the holder is a flat metal wire, a metal slice, or a polymeric material. As above, the holder is disposed between the exterior and interior layer and wrapped therein. Thus, the holder does not poke out to hurt the user, and further enhances the support function of the bra cup support structure. Moreover, the bra cup support structure is U-shaped and disposed within the lower periphery of a bra cup.

Therefore, the bra cup support structure replaces conventional underwires to support user's breast with comfort, and the adoption of the holder further enhances the support function. Consequently, the drawbacks of prior arts are overcome.

BRIEF DESCRIPTION OF THE DRAWINGS

The foregoing aspects, as well as many of the attendant advantages and features of this invention will become more apparent by reference to the following detailed description, when taken in conjunction with the accompanying drawings, wherein.

DESCRIPTION OF THE PREFERRED EMBODIMENT

The foregoing and other objects, features and advantages of the present invention will be more readily understood upon consideration of the following detailed first and second preferred embodiment's description of the invention, taken in conjunction with the following drawing.

Figure 1:
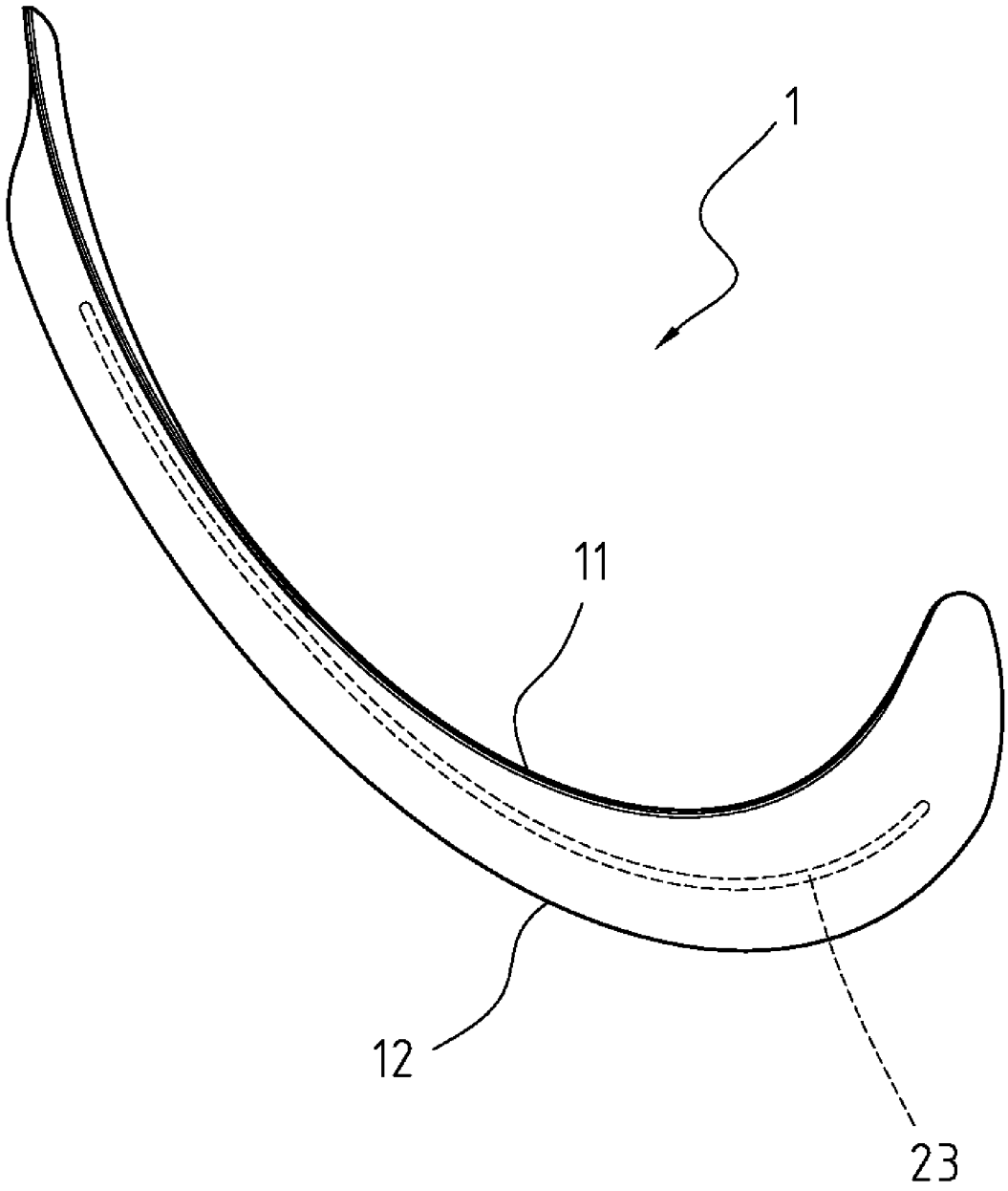
FIG. 1 is a perspective view of the bra cup support structure.
Figure 2:
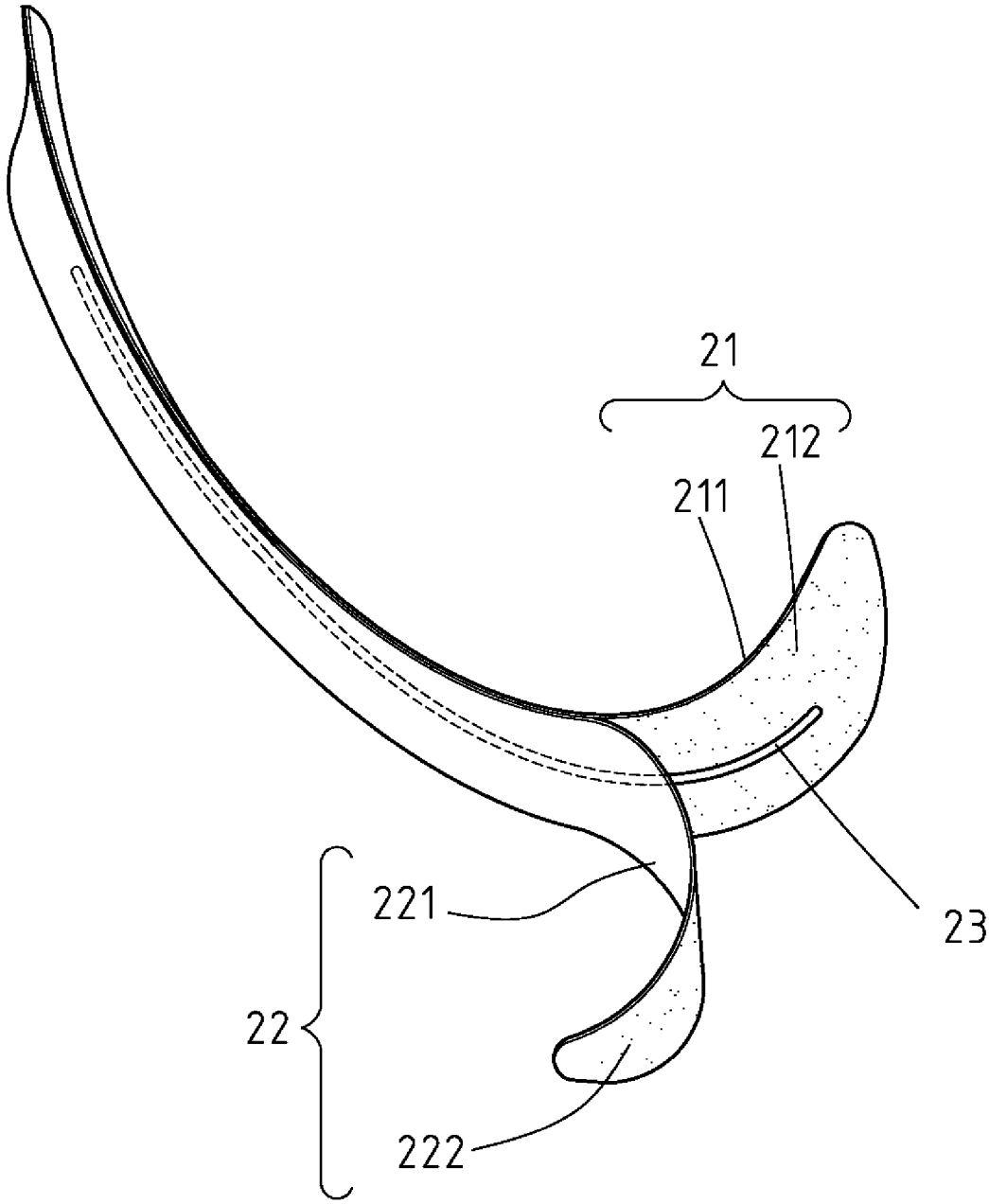
FIG. 2 is a structural view of the bra cup support structure.
Figure 3:
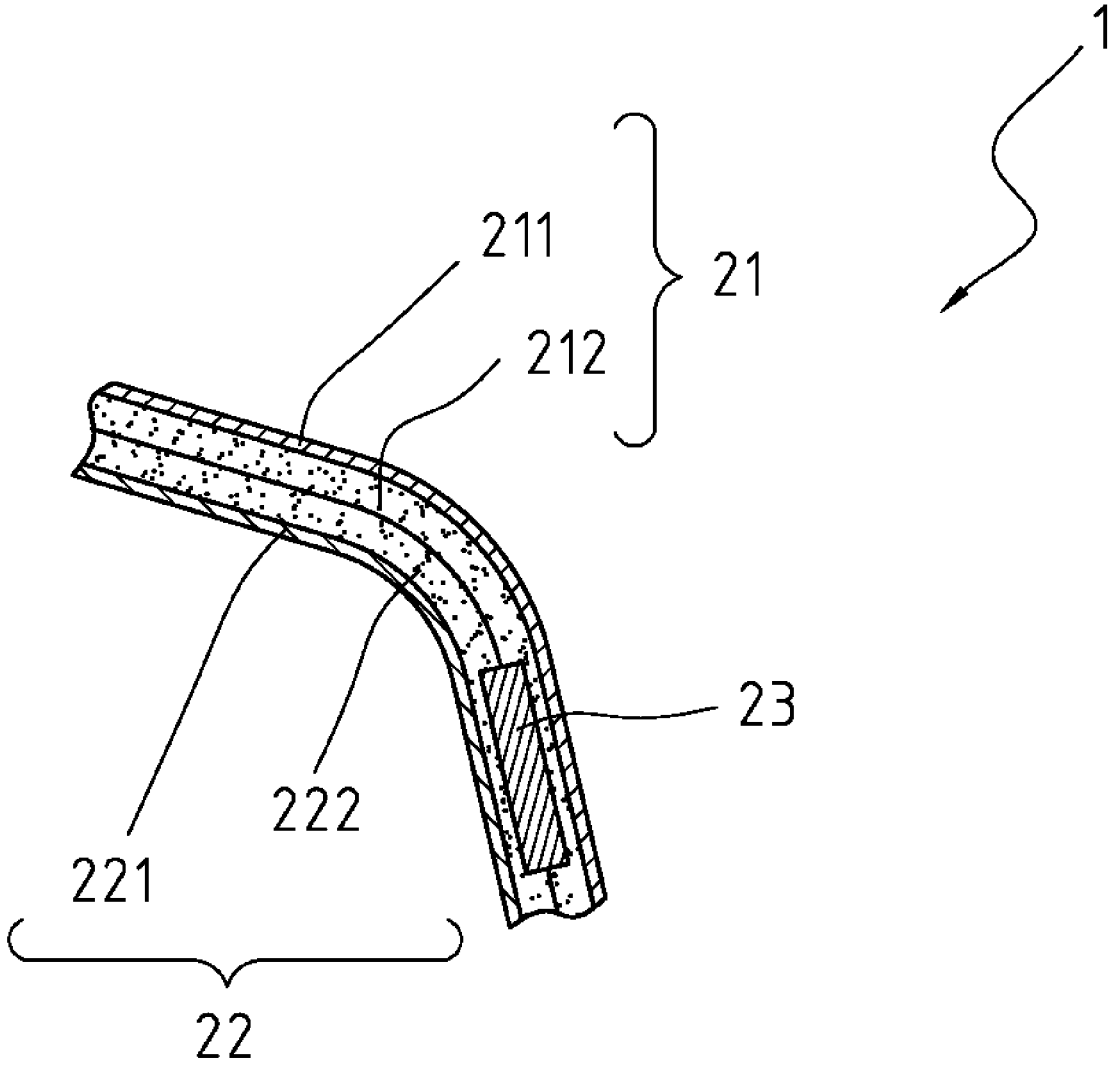
FIG. 3 is a vertical-sectional view of the bra cup support structure.
Figure 4:
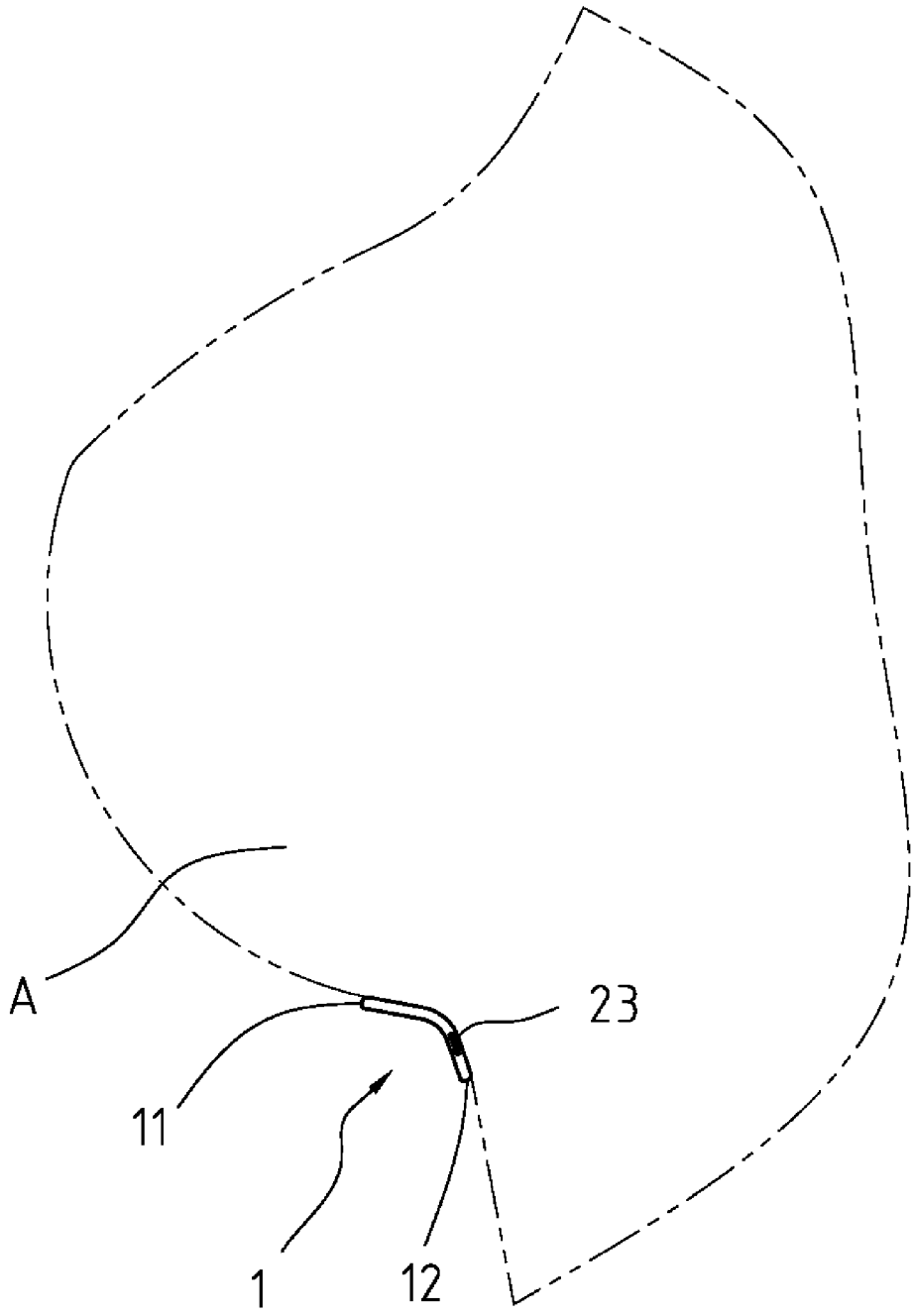
FIG. 4 is a side view of the embodiment of the bra cup support structure.

With reference to FIG. 1 and FIG. 2, illustrating the perspective view and the structural view of the bra cup support structure. The bra cup support structure 1 comprises an interior layer 21, an exterior layer 22, and a holder 23. The interior layer 21 is composed of an inner fabric layer 211 and an inner foam layer 212, which are laminated adhesively with glue, moreover, the exterior layer 22 is composed of an outer fabric layer 221 and an outer foam layer 222, which are also laminated adhesively with glue. In addition, the holder 23 is made of a polymeric material, metal slice or flat metal wire, and firmly sandwiched between the exterior layer 22 and interior layer 21, and a length of the holder 23 is shorter than a length of both layers 22, 21. As shown in FIGS. 3 and 4, the bra cup support structure 1 has, as a cross-sectional shape taken perpendicular to a lengthwise direction of the bra cup support structure 1, an inverted L-shape with an upper portion 11 that is for contacting and supporting a breast A of a user, and a lower portion 12 disposable under the breast, and for contacting a torso of the user. The holder 23 is disposed within the lower portion 12.

Please refer to FIG. 3 and FIG. 4 illustrating the vertical-sectional view and the side view of the embodiment. The bra cup support structure 1 comprises the exterior layer 22, the holder 23, and the interior layer 21, wherein the exterior layer 22 is composed of the outer fabric and foam layer 221, 222, and the interior layer 21 is composed of the inner fabric and foam layer 211, 212. In addition, the holder 23 is disposed within the lower portion 12 of the bra cup support structure 1 to enhance the support function, and it could be a metal wire, a metal slice, or a polymeric material. In the preferred embodiment, the holder 23 is a flat metal wire, and the length of the holder 23 is shorter than the length of the exterior layer 22 and interior layer 21. Additionally, the holder 23 is completely and firmly sandwiched between the exterior layer 22 and interior layer 21. Therefore, the holder 23 will not poke through the bra cup support structure 1 to hurt the user. As illustrated in FIG. 4, the upper portion 11 of the bra cup support structure 1 is utilized to support the lower edge of user's breast A. The lower portion 12 is adopted to contact user's body closely, and the holder 23 is disposed therewithin to enhance the support function of the bra cup support structure 1.

Figure 5:
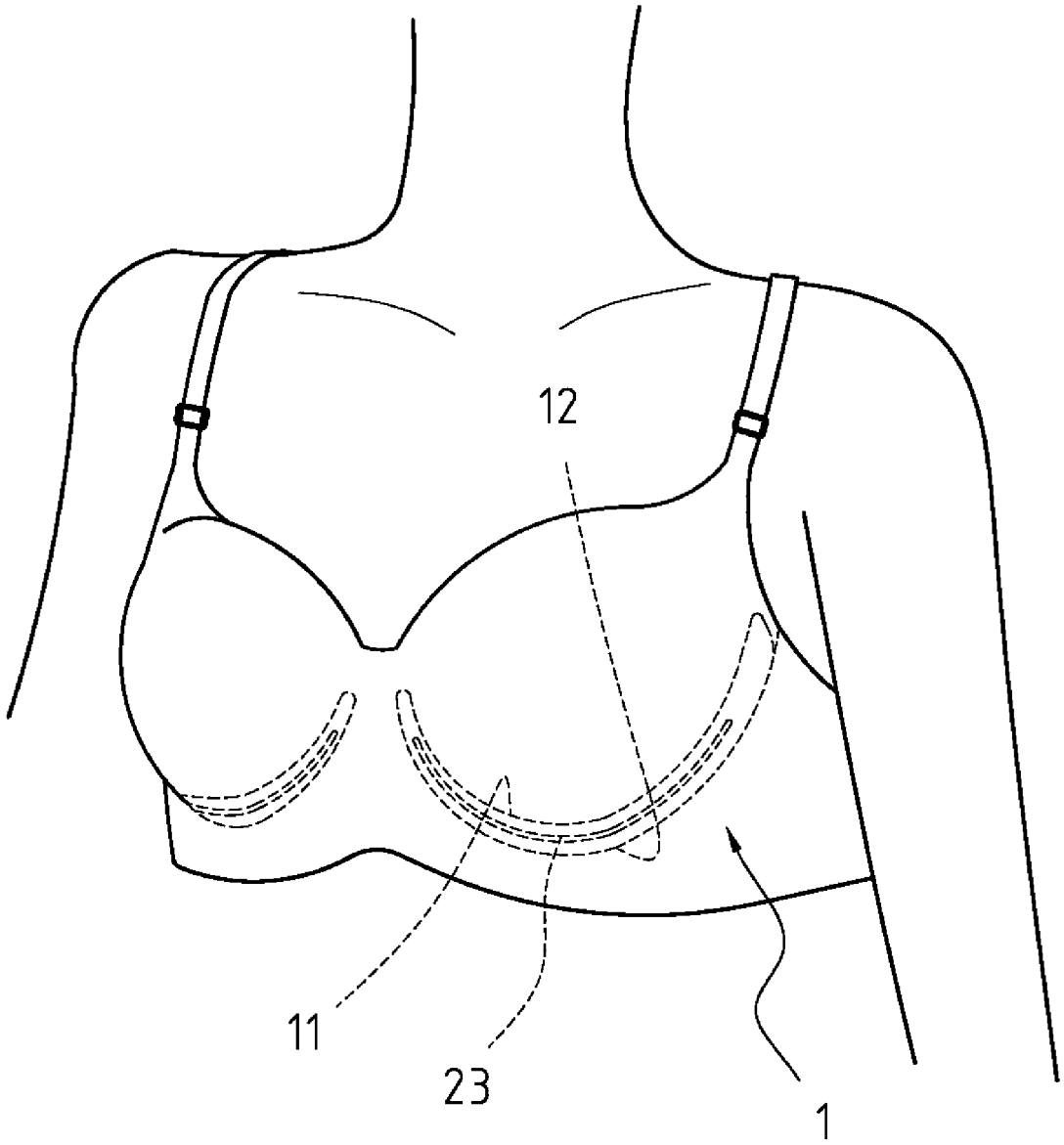
FIG. 5 is a front view of the embodiment of the bra cup support structure.

Subsequently, referring to the FIG. 5 to illustrate the front view of the embodiment of the bra cup support structure. The bra cup support structure 1 is U-shaped and disposed within the lower periphery of a bra cup. The lower portion 12 is adopted to contact user's body closely, while the upper portion 11 is utilized to support the lower edge of user's breast. The bra cup support structure 1 is designed to comply with ergonomics, so it is contacted with a user's body much more closely and uplift user's breast naturally. Besides, the bra cup support structure 1 is made of fabric and foam layers rather than other rigid materials to provide support function with comfort, and further utilizes the holder 23 to enhance the support function. Consequently, the present invention not only provides the comfortable feel to the users while wearing, but also provides the users' breasts with the support and lift function.

While the present invention has been described in connection with a preferred embodiment thereof, it will be apparent to those skilled in the art that many changes and modifications may be made without departing from the true spirit and scope of the present invention. Accordingly, it is intended by the appended claims to cover all such changes and modifications as come within the spirit and scope of the invention.

What is claimed is:

1. A bra cup support structure to be disposed within a bra cup, comprising:

an exterior layer, composed of an outer fabric layer and an outer foam layer which are laminated adhesively with glue;

an interior layer, composed of an inner fabric layer and an inner foam layer which are laminated adhesively with glue, the interior layer being disposed adjacent to the exterior layer;

a holder, made of a polymeric material, metal slice or flat metal wire, the exterior layer and the interior layer being attached to each other with the holder being firmly sandwiched between the exterior layer and interior layer, and a length of the holder being shorter than a length of the exterior and interior layers, the bra cup support structure having, as a cross-sectional shape taken perpendicular to a lengthwise direction of the bra cup support structure, an inverted L-shape with an upper portion that is for contacting and supporting a breast of a user, and a lower portion disposable under the breast, and for contacting a torso of the user, the lower portion extending downward from an edge of the upper portion, and the holder being disposed within the lower portion.

2. The bra cup support structure of claim 1, wherein the holder is made of the flat metal wire.

3. The bra cup support structure of claim 1, wherein the outer foam layer is attached to the inner foam layer, and the holder is sandwiched between the outer foam layer and the inner foam layer.

* * * * *